US011060389B2

(12) United States Patent
Wang et al.

(10) Patent No.: US 11,060,389 B2
(45) Date of Patent: Jul. 13, 2021

(54) DOWNHOLE GAS SEPARATOR

(71) Applicant: ExxonMobil Upstream Research Company, Spring, TX (US)

(72) Inventors: Jason Y. Wang, Spring, TX (US); Carl J. Dyck, Calgary (CA); Federico G. Gallo, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 88 days.

(21) Appl. No.: 16/578,857

(22) Filed: Sep. 23, 2019

(65) Prior Publication Data

US 2020/0141222 A1 May 7, 2020

Related U.S. Application Data

(60) Provisional application No. 62/754,384, filed on Nov. 1, 2018.

(51) Int. Cl.

| | |
|---|---|
| ***E21B 43/38*** | (2006.01) |
| ***E21B 37/00*** | (2006.01) |
| *E21B 43/12* | (2006.01) |

(52) U.S. Cl.

CPC ..... *E21B 43/38* (2013.01); *E21B 37/00* (2013.01); *E21B 43/126* (2013.01); *E21B 43/128* (2013.01)

(58) Field of Classification Search

CPC ..... E21B 43/38

See application file for complete search history.

(56) References Cited

U.S. PATENT DOCUMENTS

| | | | | |
|---|---|---|---|---|
| 7,270,178 | B2 | 9/2007 | Selph | |
| 2002/0040783 | A1* | 4/2002 | Zimmerman | E21B 47/00 166/366 |
| 2003/0056811 | A1* | 3/2003 | Walker | E21B 21/00 134/18 |
| 2003/0145989 | A1* | 8/2003 | Shaw | E21B 43/38 166/265 |
| 2006/0002808 | A1* | 1/2006 | Williams | E21B 43/38 417/555.1 |
| 2007/0051509 | A1* | 3/2007 | Selph | E21B 43/38 166/105 |
| 2015/0204169 | A1* | 7/2015 | Coates | E21B 43/128 166/369 |
| 2016/0319653 | A1* | 11/2016 | Reeves | E21B 43/121 |
| 2017/0138166 | A1 | 5/2017 | Wang et al. | |
| 2017/0138167 | A1* | 5/2017 | Wang | B01D 19/0042 |

* cited by examiner

*Primary Examiner* — David Carroll

(74) *Attorney, Agent, or Firm* — Leandro Arechederra, III

(57) ABSTRACT

Systems and a method for efficient downhole separation of gas and liquids. An exemplary system provides a downhole gas separator for an artificial lift system. The downhole gas separator includes a separation section. The separation section includes a number of openings over an extended length, and wherein a size of each of the openings, a number openings, or both, is increased as a distance from a production tubing is increased.

10 Claims, 9 Drawing Sheets

100

200

700

700

DOWNHOLE GAS SEPARATOR

CROSS REFERENCE TO RELATED APPLICATION

This application claims the benefit of U.S. Provisional Application Ser. No. 62/754,384, filed Nov. 1, 2018, titled, "Downhole Gas Separator," and is related to U.S. Provisional Application Ser. No. 62/752,715, filed Oct. 30, 2018, titled "Downhole Gas Separator", the entireties of which are incorporated by reference herein.

FIELD

The techniques described herein relate to downhole gas separation systems. More particularly, the techniques relate to gas separation systems that allow servicing of a well without removal of the gas separation system from the well.

BACKGROUND

This section is intended to introduce various aspects of the art, which may be associated with example examples of the present techniques. This discussion is believed to assist in providing a framework to facilitate a better understanding of particular aspects of the present techniques. Accordingly, it should be understood that this section should be read in this light, and not necessarily as admissions of prior art.

Artificial lift systems are often used to produce liquid hydrocarbons from a hydrocarbon well. The artificial lift systems may include reciprocating pumps, such as a plunger lift system, or continuous pumps, such as downhole electric pumps.

However, gas that is present within the subterranean formation may become entrained with liquid hydrocarbon, and reduce the operational efficiency of the artificial lift system. In some situations, the gas may cause the artificial lift system to stop working. The decrease in operational efficiency may be mitigated by using a downhole gas separator to separate gas from the liquid hydrocarbons prior to the entry of liquid hydrocarbon into the artificial lift system. The gas is often diverted to the casing, while the liquid hydrocarbons are produced through a production tube, disposed within the casing.

Research has continued into identifying efficient downhole gas separators. For example, U.S. Patent Application Publication No. 2017/0138166, by Wang et al., discloses downhole gas separators and methods of separating a gas from a liquid within a hydrocarbon well. As described therein, the downhole gas separators include an elongate outer housing that defines an enclosed volume, a fluid inlet port, and a gas outlet port. The downhole gas separators further include an elongate dip tube that extends within the enclosed volume, and the gas outlet port is configured to selectively provide fluid communication between the enclosed volume and an external region.

Similarly, U.S. Patent Application Publication No. 2017/0138167, by Wang et al., discloses a horizontal well production apparatus and a method for using the same. The application describes artificial lift apparatus, systems, and methods for use in a deviated or horizontal well bore, including downhole gas separators, hydrocarbon wells including the artificial lift systems, and methods of separating a gas from a liquid hydrocarbon within a hydrocarbon well. A downhole gas separator is positioned in a deviated or horizontal wellbore. The downhole gas separator includes a flow regulating device configured to restrict fluid flow through the gas outlet during at least a portion of each intake stroke of a reciprocating pump and to permit the fluid flow during at least a portion of each exhaust stroke of the reciprocating pump.

While improving the separation efficiency of a downhole gas separator may improve the operational efficiency of the artificial lift system, current downhole gas separators may increase operational costs for wells. For example, performing cleanout procedures, and other procedures in the well, often requires that the downhole gas separators and production tubing are removed from the wellbore before the procedures are performed.

SUMMARY

An embodiment described herein provides a downhole gas separator for an artificial lift system, including a separation section. The separation section includes a number of openings over an extended length, and wherein a size of each of the openings, a number of the openings, or both, is increased as a distance from a production tubing is increased.

Another embodiment described herein provides a method for servicing a well having a downhole gas separator. The method includes running a well intervention tool through the downhole gas separator, and servicing the well through an open end of the downhole gas separator.

Another embodiment described herein provides a system to produce liquids from a well. The system includes production tubing placed inside the well casing that is configured to transfer liquid to a surface with a pump and a downhole gas separator. The downhole gas separator includes a separation section, wherein the separation section comprises a plurality of openings over an extended length.

DESCRIPTION OF THE DRAWINGS

The foregoing and other advantages of the present techniques may become apparent upon reviewing the following detailed description and drawings of non-limiting examples of examples in which.

Figure 1:
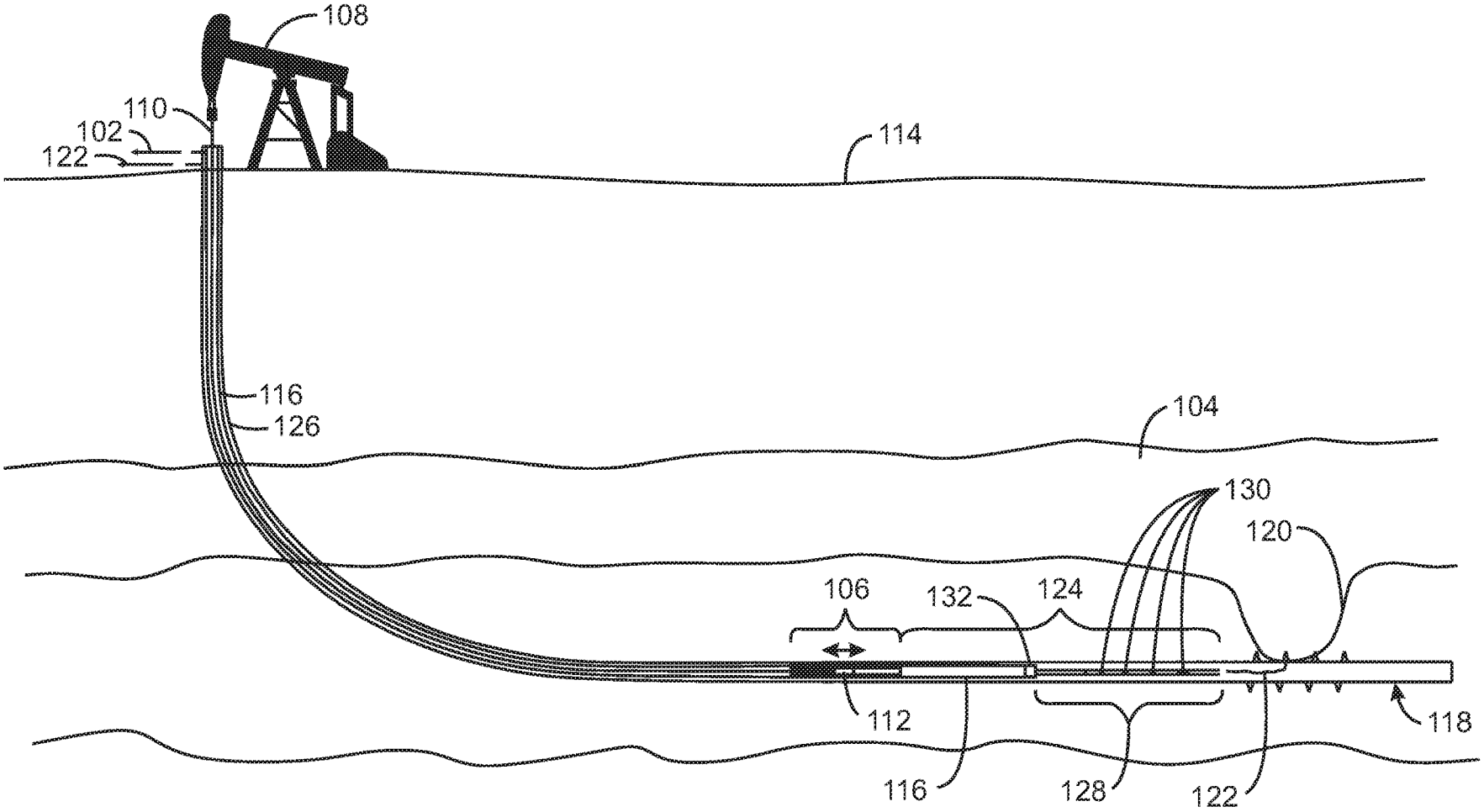
FIG. 1 is a drawing of a system for producing liquid from a reservoir using a pump, in accordance with examples.

It should be noted that the figures are merely examples of several embodiments of the present techniques and no limitations on the scope of the present techniques are intended thereby. Further, the figures are generally not drawn to scale, but are drafted for purposes of convenience and clarity in illustrating various aspects of the techniques.

DETAILED DESCRIPTION

In the following detailed description section, the specific examples of the present techniques are described in connection with preferred examples. However, to the extent that the following description is specific to a particular embodiment or a particular use of the present techniques, this is intended to be for example purposes only and simply provides a description of the example examples. Accordingly, the techniques are not limited to the specific examples described below, but rather, it includes all alternatives, modifications, and equivalents falling within the true spirit and scope of the appended claims.

Gas entrainment during production from wells may interfere with pumping efficiency, and may result in a complete drop-off of liquid production. Further, low gas separation efficiency using some current technologies may result in limited liquid production rate. Separators have been tested to mitigate this problem, for example, available from the Weatherford Corporation, have demonstrated an increase in liquid production due to more efficient gas separation. However, these separators have required pulling the production tubing to perform well interventions, such as coiled tubing workovers (CTW), joint tubing interventions, wireline interventions, or other well interventions using a well intervention tool. A separator that would allow a well intervention without pulling the production tubing would have a significant economic impact. As used herein, an intervention includes, for example, a well cleanout, well treating, replacement of downhole parts and devices, and the like.

Examples described herein provide downhole gas separators that allow efficient separation of gas from liquids, while permitting well interventions to be performed in the well without pulling the production tubing string from the well. In some examples, the downhole gas separator is physically joined to the production tubing at one end. In these examples, the downhole gas separator is open-ended at the opposite end from the production tubing to allow well interventions. In other examples, the separation section is directly connected to the pump. In these examples, an extension section is coupled to the separation section to allow the downhole gas separator and the attached pump to be inserted into the well. The extension section may be a solid piece that is weighted at the bottom to orient the downhole gas separator by gravity. In some examples, the extension section may be hollow, with an open end to increase the intake of fluid. In examples with the extension section, the downhole gas separator is pulled out of the well along with the pump to allow well interventions through the production tubing.

The separation section includes annular perforations that increase in size or number as the distance between the annular perforations and the production tubing or pump increases. The annular perforations pull liquid from a pool of liquid in the well bore into the pump. In some examples, the smaller size of the annular perforations near the production tubing or pump limits the intake of liquid through those smaller perforations, lowering the likelihood of gas entrainment through those perforations. In other examples, the perforations may be the same size across the entire downhole gas separator, such as in a vertical installation.

The downhole gas separators described herein take advantage of naturally stratified flow in slightly slanted wellbores, for example, between about 60 and about 100 degrees inclination where zero degrees inclination is vertical. In the stratified flow, gas rides along the top surface of the wellbore, while liquids accumulate along the bottom surface. Further, the downhole gas separators may be useful for wells with limited casing diameter. In these wells, a conventional dip-tube style design may create a small annular space that results in higher velocity, which results in lower efficiency for gas separation in high flowrate wells.

The systems and techniques described herein may be very effective for intermittent type pumps, such as reciprocating piston pumps. The extended length of the separation section, for example, about 1 m in length, about 2 m in length, or about 3 m in length, or longer, allows an inventory of liquid to build up in the wellbore during the downstroke of the reciprocating piston pump, which is available to be sucked into the downhole gas separator during the upstroke of the reciprocating piston pump.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, "artificial lift" techniques are used to produce liquid hydrocarbons from reservoirs through wells. The artificial lift techniques are implemented by devices such as reciprocating piston pumps and electric submersible pumps, among others. Reciprocating piston pumps use a piston which is actuated by a rod from the surface. The piston moves up and down in a cylinder that forms the pump. As the rod forces the piston downwards in the cylinder, pressure opens a valve on the piston allowing liquids to flow past the piston. When the rod reaches a full downwards extension, the rod starts to pull the piston upwards, which closes the valve on the piston and allows the liquid to be lifted by the piston. As the piston is lifted, the pressure drop below it causes a valve on the bottom of the cylinder to open, allowing more fluid to flow into the cylinder. As the piston is pulled upwards, the liquid flows out of the top of the cylinder towards the surface, for example, through a production line. When the rod reaches a full upwards extension, and starts to push the piston downwards, the valve on the bottom of the cylinder closes. The cycle is then repeated as the rod pushes the piston back downwards, with the valve on the piston opening to allow liquids to flow past the piston. This reciprocating action pumps liquids to the surface.

A progressive cavity pump (PCP) is another type of artificial lift system used pump liquids from a reservoir to the surface. A PCP is a continuous pump that is powered by a motor at the surface that is coupled by a rotating rod to the PCP, which is placed in the well.

An electrical submersible pump (ESP) is another type of artificial lift system used pump liquids from a reservoir to the surface. An ESP is a continuous pump that is powered by an electric cable from the surface, and is placed in the well. The ESP may be used in wells for which a higher production rate is desirable, or where the use of a reciprocating oil pump may not be practical.

As used herein, "casing" refers to a protective lining for a wellbore. Any type of protective lining may be used, including those known to persons skilled in the art as liner, casing, tubing, etc. Casing may be segmented or continuous, jointed or unjointed, made of any material (such as steel, aluminum, polymers, composite materials, etc.), and may be expanded or unexpanded, etc.

As used herein, "crude oil" or "hydrocarbon liquids" are used to denote any carbonaceous liquid that is derived from petroleum.

As used herein, "gas" refers to any chemical component that exists in the gaseous state, i.e., not liquid or solid, under relevant downhole conditions regardless of the identity of the chemical substance. For example, the gas may include methane, ethane, nitrogen, helium, carbon dioxide, water vapor, or hydrogen sulfide, or any combinations thereof, among others.

As used herein, "liquid" refers to any chemical component that exists in the liquid state, i.e., not gas or solid, under relevant downhole conditions regardless of the identity of the chemical substance. For example, the liquid may include crude oil or water, or any combinations thereof, among others.

As used herein, "production tubing" is a tubular line used to convey liquid hydrocarbons from a formation to the surface. At the surface, the production tubing couples to a wellhead that transfers the liquid hydrocarbons to a production line for collection. The production tubing is often placed in a cased well. This creates an outer annulus that may be used to convey gas, separated from the liquid hydrocarbon, to the surface.

A "well" or "wellbore" refers to holes drilled to produce liquid or gas from subsurface reservoirs. The wellbore may be drilled vertically, or at a slant, with deviated, highly deviated, or horizontal sections of the wellbore. The term also includes wellhead equipment, surface casing, intermediate casing, and the like, typically associated with oil and gas wells.

FIG. 1 is a drawing of a system 100 for producing liquid 102 from a reservoir 104 using a pump 106, in accordance with examples. In the example shown in FIG. 1, the pump 106 is a reciprocating rod pump, in which a pump jack 108 moves a rod 110 that moves a piston 112 in the pump 106. The rod 110, may be a sucker rod or a continuous rod. As described herein, as the piston is pulled towards the pump jack 108 it pushes the liquid 102 to the surface 114, through production tubing 116.

However, during periods in a cycle in which the piston 112 is moving towards the pump jack 108, the lower pressure in the wellbore 118 may draw down the hydrocarbon liquid level 120 in the reservoir 104, leading to the entrainment of gas 122 in the liquid 102. This may lower the effectiveness of the pump 106, decreasing the amount of liquid 102 that reaches the surface 114. In some cases, the entrainment of the gas 122 in the liquid 102 may stop the ability of the pump 106 to move the liquid 102 to the surface 114.

To decrease or eliminate the entrainment of the gas 122 in the liquid 102, a downhole gas separator 124 may be coupled to the production tubing 116. The downhole gas separator 124 takes advantage of the naturally stratified flow in a slightly slanted, or near horizontal, wellbore 118, for example, between about 60° and about 100° inclination, where 0° inclination is vertical. Gas 122 flows along the top of the wellbore while liquids accumulate at the bottom of the wellbore 118. The downhole gas separator 124, pulls liquid 102 that has accumulated along the bottom of the wellbore while allowing the gas to flow over the liquids.

In various examples, the downhole gas separator 124 has a separation section 128 with annular perforations 130 that are formed along the separation section 128. The separation section 128 is coupled to the production tubing 116 by a coupling 132. In this example, the production tubing 116 holds the pump 106. In some examples, the annular perforations 130 increase in size, or are placed closer together, as the distance from the production tubing 116 increase. This is discussed in further detail with respect to the following figures.

It can be noted that the liquid 102 may be a hydrocarbon liquid, water, or a mixture of hydrocarbon liquid and water. In various examples, the liquid 102 is processed at the surface to separate hydrocarbon liquid and water.

Figure 2:
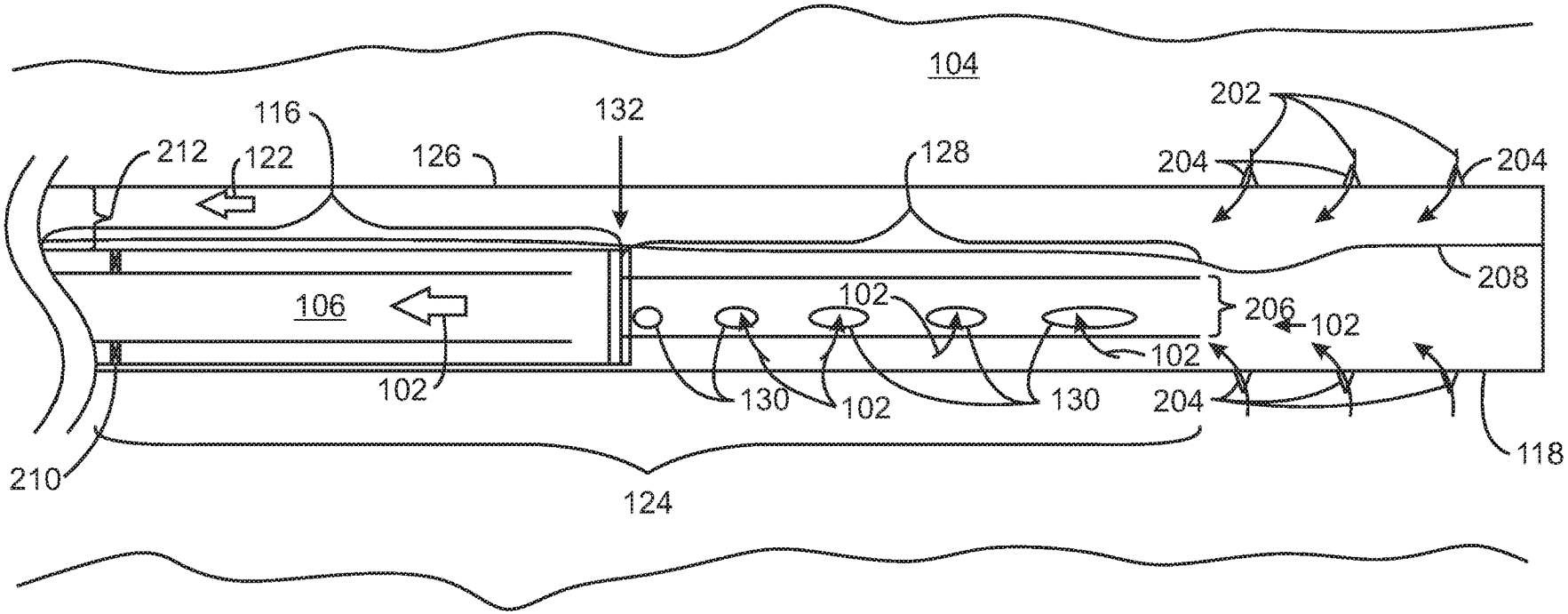
FIG. 2 is a schematic diagram of the operation of a downhole gas separator with annular perforations, in accordance with examples.

FIG. 2 is a schematic diagram of the operation of a downhole gas separator 124, in accordance with examples. Like numbered items are as described with respect to FIG. 1. In the schematic diagram 200, material 202 from the reservoir 104 may enter the casing 126 of the wellbore 118 through well perforations 204, may diffuse into an un-cased segment of the wellbore 118, or through completion screens, and flow to the pump 106. The material 202, which may include liquid and gas from the reservoir 104, may be pulled into the separation section 128 through the annular perforations 130, the open end 206 of the separation section 128, or both, by a reciprocating piston pump, PCP, ESP, or other pump 106.

The open end 206 of the separation section 128 and the larger annular perforations 130, near the open end 206 of the separation section 128, may allow liquid 102 to freely enter the separation section 128 during a pumping cycle of a reciprocating piston pump. However, a high flow rate may pull the liquid level 208 down and entrain gas 122 into the liquid 102 entering the open end 206 of the separation section 128. The smaller annular perforations 130 in the separation section 128 that are placed proximate to the coupling 132 to the production tubing 116 distribute the entry rate of the liquid 102 across a wider area. This may decrease the flow rate across the open area, which may decrease the lowering of the liquid level in any one particular area around the separation section 128, decreasing the probability of pulling a liquid level below one of the annular perforations 130 and entraining gas 122. Accordingly, the separation section 128 may separate the liquid 102 which passes through the separation section 128 to the pump 106, which is sealed in the production tubing 116 by a friction ring 210, to be pumped to the surface. The gas 122 then flows to the surface through an outer annulus 212. As shown in FIG. 2, the outer annulus 212 is between the production tubing 116 and the well casing 126 around the downhole gas separator 124.

The techniques are not limited to the use of a reciprocating piston pump as the pump 106. As described herein, a progressive cavity pump (PCP) may be used to continuously flow liquid to the surface. In this example, the annular perforations 130 may provide a path for liquid 102 to be pulled in through the downhole gas separator 124 without entraining gas.

Figure 3A:
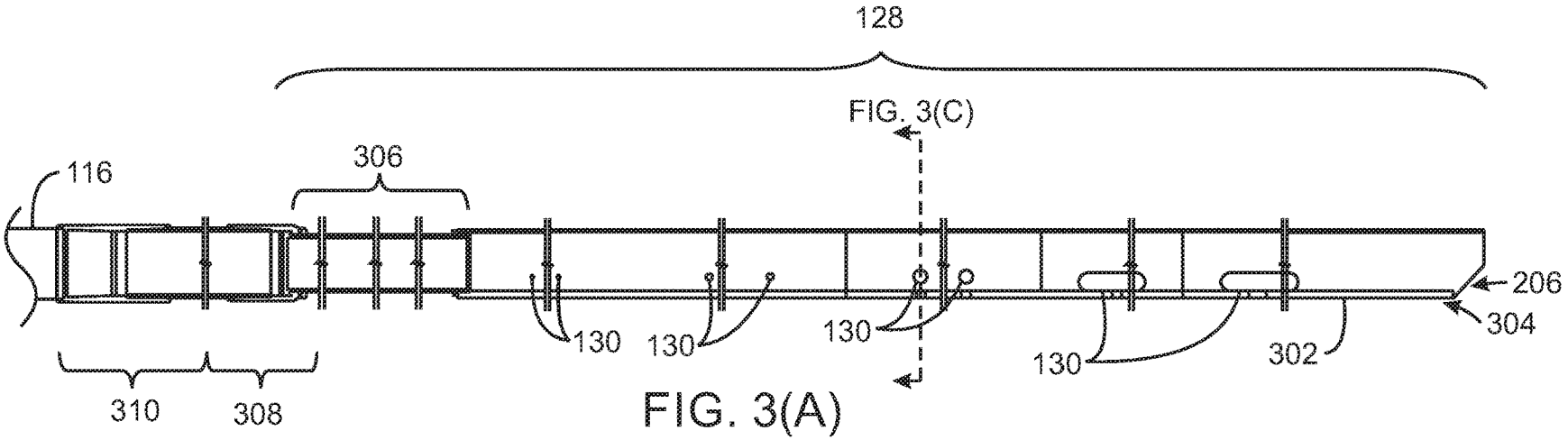
FIGS. 3(A) and 3(B) are side and bottom views of a downhole gas separator with annular perforations, in accordance with examples.
Figure 3B:
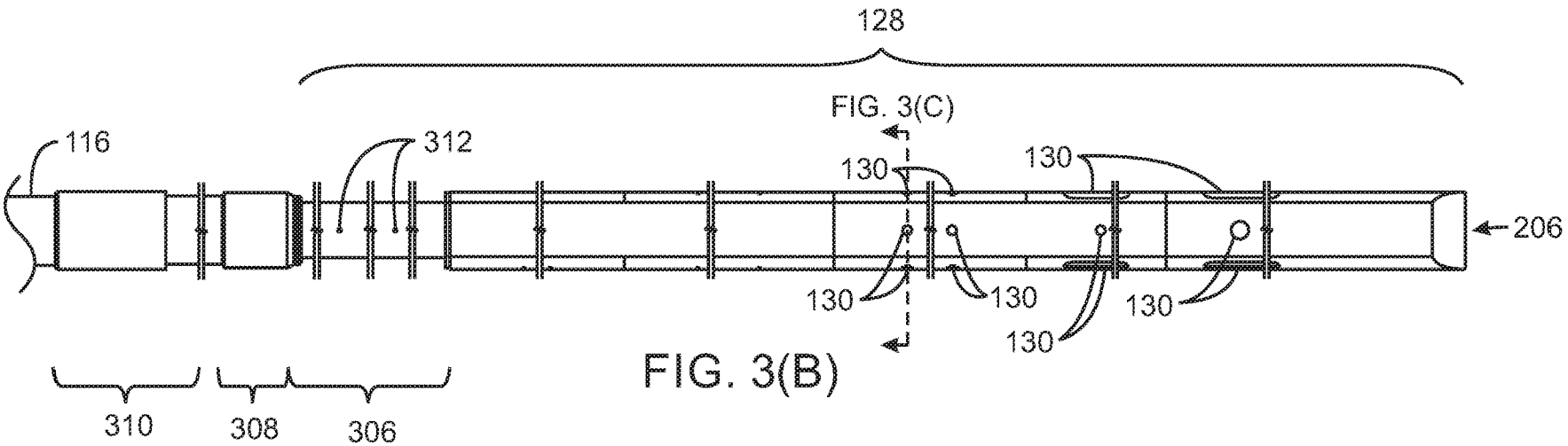

FIGS. 3(A) and 3(B) are side and bottom views of a downhole gas separator 124 with annular perforations 130, in accordance with examples. Like numbered items are as described with respect to FIGS. 1 and 2. In the side view of FIG. 3(A), the separation section 128 is shown from the side. The open end 206, or toe, of the separation section 128 is beveled to allow the separation section 128 to ride over debris and ledges in a wellbore or casing.

A weighted plate 302 is attached to the bottom of the separation section 128. The weighted plate 302 provides a weight to rotate the separation section 128 under the force of gravity to keep the bottom 304 of the separation section 128 aligned with the bottom surface of a wellbore. In some examples, an eccentric weight distribution is used in place of a separate weighted plate structure. The mounting of the weighted plate 302 to the separation section 128 is discussed further with respect to the cross-sectional view of FIG. 3(C).

To allow the rotation under the influence of gravity, the separation section 128 is attached to a swivel bushing 306, which is inserted into a swivel coupling 308. As the separation section 128 is pushed into the wellbore, the swivel coupling 308 allows the rotation of the separation section 128. A coupling section 310 joins the downhole gas separator 124 to the production tubing 116.

Although weighted plate 302 is shown, or other eccentric weighting features are mentioned, in some examples, the separation section 128 does not have an eccentric feature. In these examples, the separation section 128 may have the variably sized holes distributed around the circumference along the length of the separation section 128. This may be useful in installations in vertical or more steeply inclined wells.

FIG. 3(B) is a bottom view of the downhole gas separator 124, illustrating the annular perforations 130 that are in the bottom of the downhole gas separator 124, in accordance with examples. This view also illustrates small perforations 312 that may be placed in the bottom of the swivel bushing 306 for an additional path for liquid to enter the downhole gas separator 124. The location of the annular perforations 130 towards and on the bottom 304 of the downhole gas separator 124 allows pooled liquid proximate to the bottom side of the casing to be pulled into the downhole gas separator 124, while decreasing the possibility of pulling gas down through a liquid into the downhole gas separator 124.

Figure 3C:
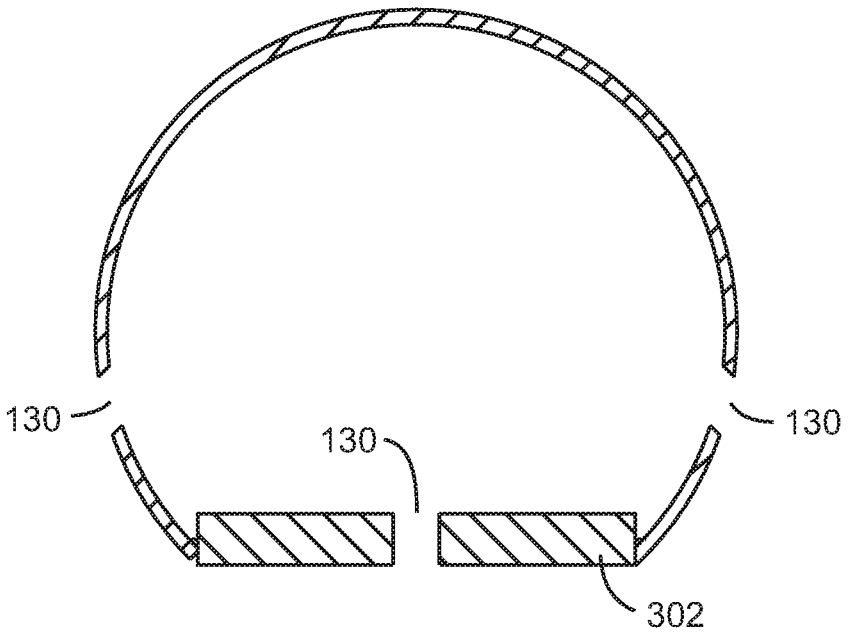
FIG. 3(C) is a cross-sectional view of the downhole gas separator, taken through annular perforations in the separation section, in accordance with an example.

FIG. 3(C) is a cross-sectional view of the downhole gas separator 124, taken through annular perforations 130 in the separation section 128, in accordance with an example. This view shows the weighted plate 302 placed at the bottom of the downhole gas separator 124. The view also shows annular perforations 130 placed along the sides and the bottom of the downhole gas separator 124.

Figure 4:
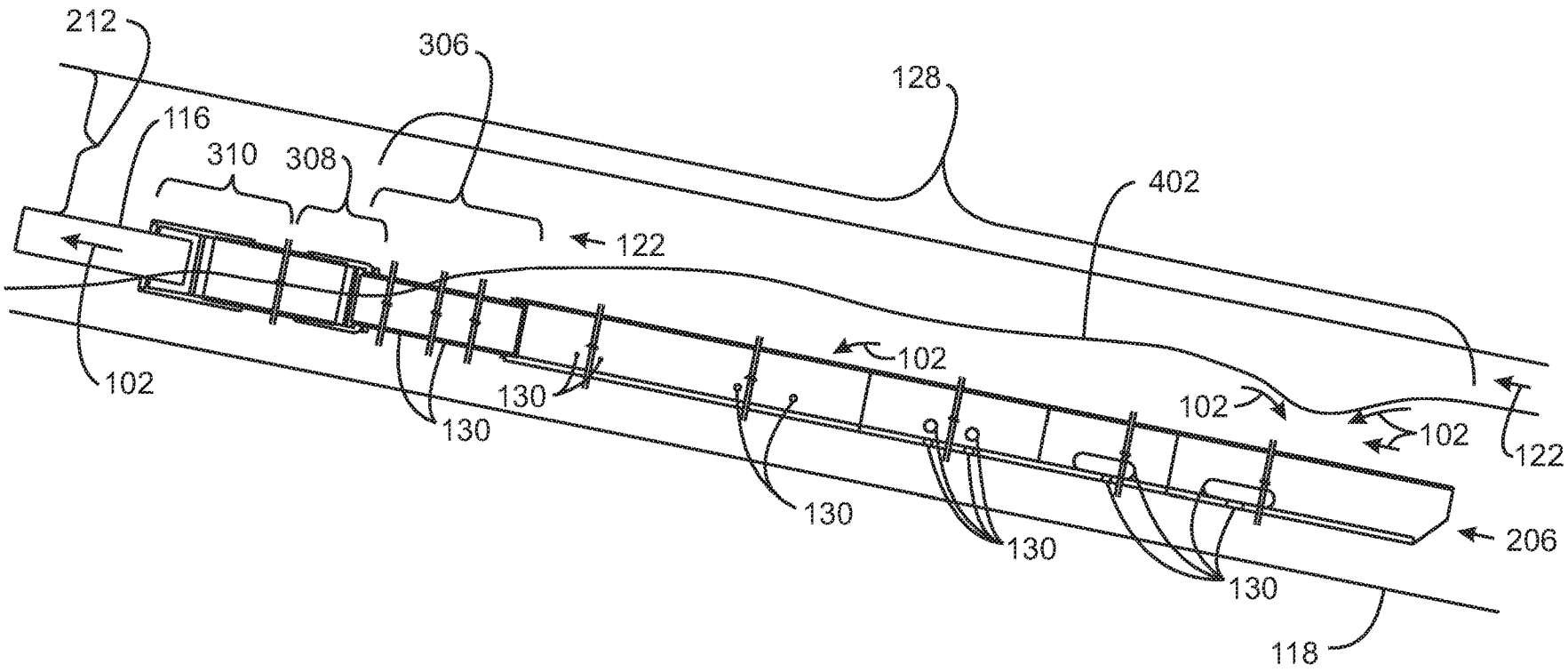
FIG. 4 is a side view of the downhole gas separator with annular perforations placed in a wellbore, in accordance with examples.

FIG. 4 is a side view of the downhole gas separator 124 with annular perforations 130 placed in a wellbore 118, in accordance with examples. Like numbered items are as discussed with respect to FIGS. 1, 2, and 3. As shown in FIG. 4, the gas 122 forms a stratified flow with the liquid 102, wherein the liquid 102 is proximate to the bottom of the wellbore 118. The separation section 128 of the downhole gas separator 124 is inserted into the liquid section, and oriented by the weighted plate 302 to pull the annular perforations 130 closer to the bottom of the wellbore 118. The liquid 102 is then pulled into the separation section 128 through the open end 206 and the annular perforations 130, while the gas 122 flows up the outer annulus 212.

The annular perforations 130 may be optimized for the transfer of materials into the separation section 128. In various examples, the annular perforations 130 are placed to optimize the transfer of liquid 102 from a wellbore 118 into the separation section 128. Smaller annular perforations 130 higher in the wellbore 118, for example, in the swivel bushing 306 may decrease the amount of the gas 122 that is entrained in the liquid 102 should the level 402 of the liquid 102 drop and expose the smaller annular perforations 130.

The downhole gas separator 124 with the annular perforations 130 described with respect to FIGS. 3 and 4 is not the only design that may be used. Other designs, such as the downhole gas separator 500 described with respect to FIGS. 5(A) and 5(B) may also be used. Functionally, the operation of this downhole gas separator 500 may be the same as design described with respect to FIGS. 3 and 4, but the downhole gas separator 500 may be simpler in use.

Figure 5A:
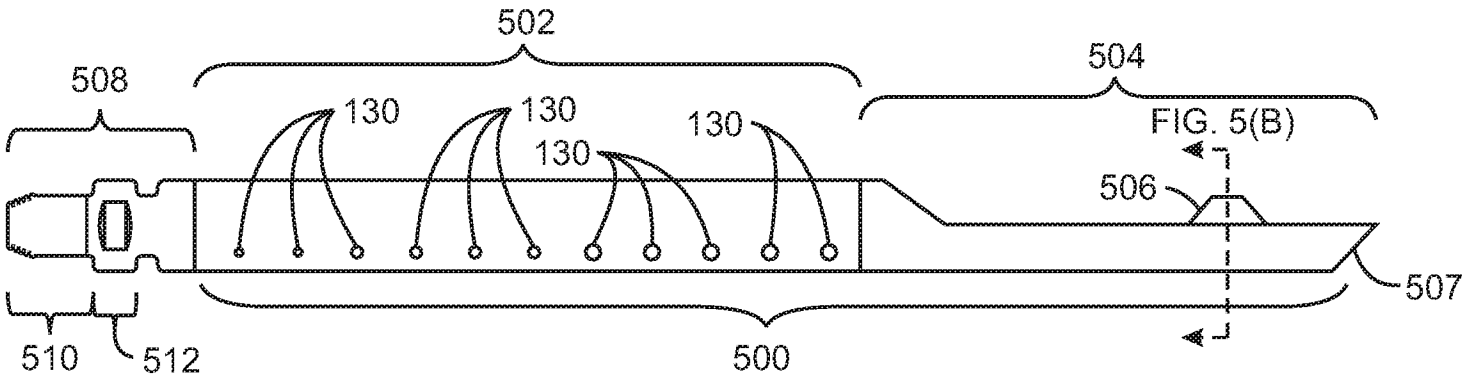
FIGS. 5(A) and 5(B) are side and front views of another downhole gas separator with annular perforations, in accordance with examples, in accordance with examples.
Figure 5B:
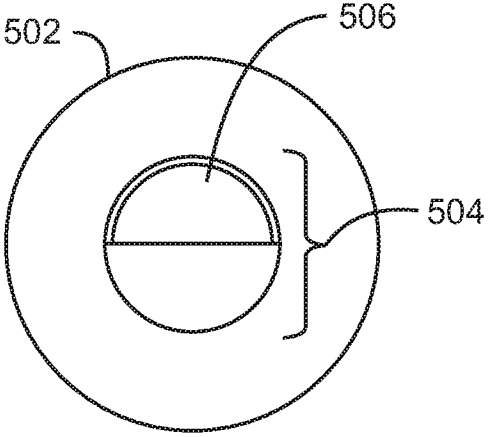

FIGS. 5(A) and 5(B) are side and front views of another downhole gas separator 500 with annular perforations 130, in accordance with examples. Like numbered items are as described with respect to FIGS. 1 and 2. In this downhole gas separator 500, separation section 502 is attached to an extension section 504. In the example shown, the extension section 504 is a solid piece that has an eccentric cross-section, for example, as shown with respect to FIG. 5(B). The increased weight at the bottom of the eccentric cross-section tends to rotate the downhole gas separator 500 to align with the bottom of a wellbore, placing the annular perforations 130 closer to the bottom of the wellbore.

The extension section 504 may have an eccentric semi-circle profile as shown in FIG. 5(B). A centralizer 506 assists in aligning the extension section 504 in the wellbore, for example, allowing the extension section 504 to freely rotate in the wellbore. The angled end 507 of the extension section 504, termed a mule shoe, helps to prevent the extension section 504 from getting caught on ledges, debris, or other material in the casing or tubing.

In this example, the downhole gas separator 500 is configured to be directly attached to a pump through a connector 508. The connector 508 has a threaded section 510 to thread to the pump barrel. A collar 512 has a wrench flat section to make assembly easier. The collar 512 may have radii built into the intersecting edges for stress relief.

The design of the downhole gas separator 500 shown in FIGS. 5(A) and 5(B) does not need the weighted plate, the swivel coupling, or the swivel bushing of the previous design for the downhole gas separator 124 as the pump may act as a swivel section to allow the downhole gas separator 500 to rotate. In some examples, a swivel section may be included between the pump and the downhole gas separator 500. A swivel function may be built into the connector 508 such that connector 508 swivels so that the threaded connector section 510 rotates independently from the rest of the gas separator assembly, section 502.

The simpler design may lower costs for the downhole gas separator 500 discussed with respect to FIGS. 5(A) and 5(B). However, in some wellbores, the previous design may work better. For example, wells with small diameter pumps and large casing sizes may benefit from the larger-diameter gas separator that is deployed on the bottom of the production tubing.

Figure 6:
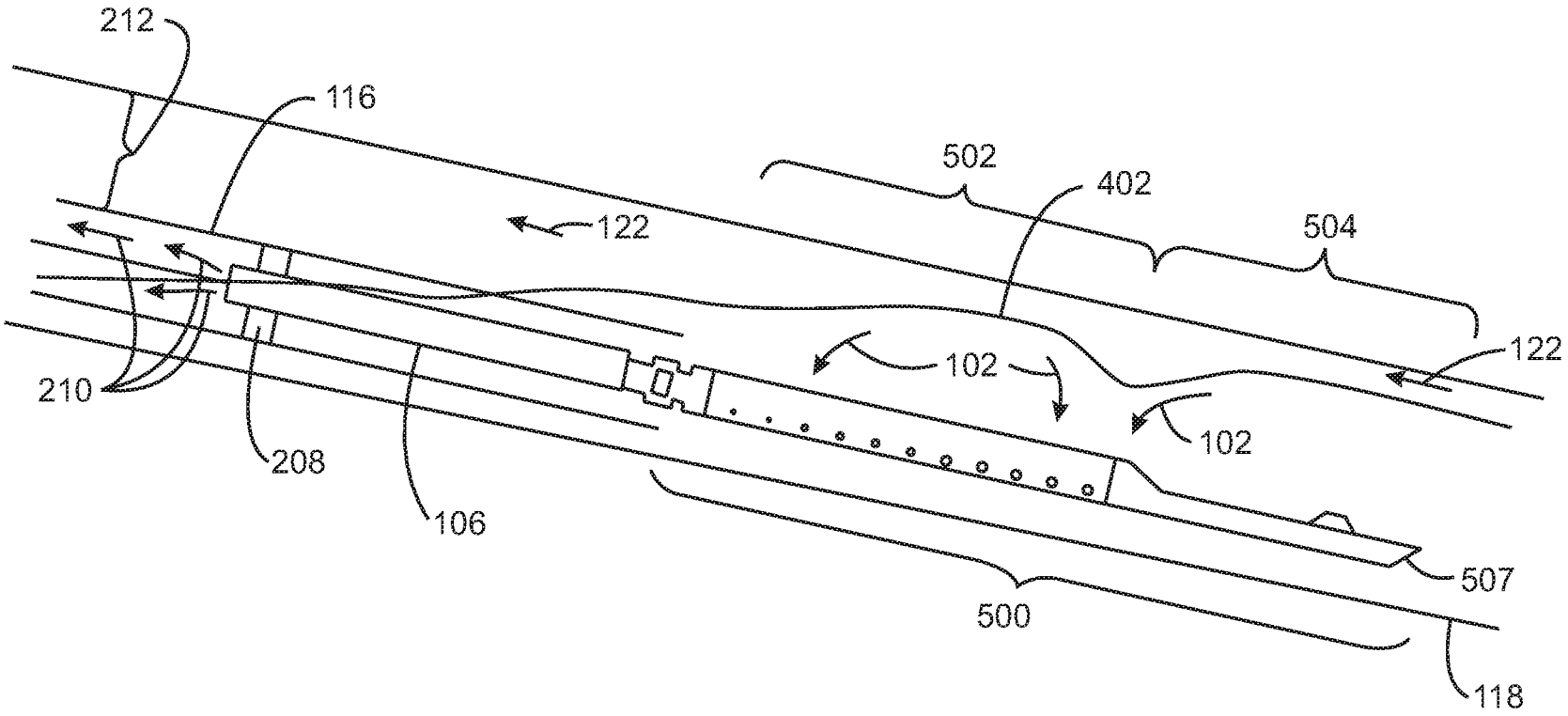
FIG. 6 is a side view of the downhole gas separator of FIGS. 5(A) and 5(B) placed in a wellbore, in accordance with examples.

FIG. 6 is a side view of the downhole gas separator 500 of FIGS. 5(A) and 5(B) placed in a wellbore 118, in accordance with examples. Like numbered items are as discussed with respect to FIGS. 1, 2, 4, and 5. Similarly to FIG. 4, the gas 122 is in a stratified flow with the liquid 102, wherein the liquid 102 is at the bottom of the wellbore 118. The separation section 502 of the downhole gas separator 124 is inserted into the liquid section, and oriented by the eccentric weight distribution of the extension section 504 to pull the annular perforations 130 closer to the bottom of the wellbore 118. The liquid 102 is then pulled into the separation section 128 through the annular perforations 130, while the gas 122 flows up the outer annulus 212.

The annular perforations 130 may be optimized for the transfer of materials into the separation section 128. In various examples, the annular perforations 130 are placed to optimize the transfer of liquid 102 from the wellbore 118 into the separation section 502. Smaller annular perforations 130 higher in the wellbore 118 may decrease the amount of the gas 122 that is entrained in the liquid 102 should the level 402 of the liquid 102 drop and expose the smaller annular perforations 130.

Figure 7A:
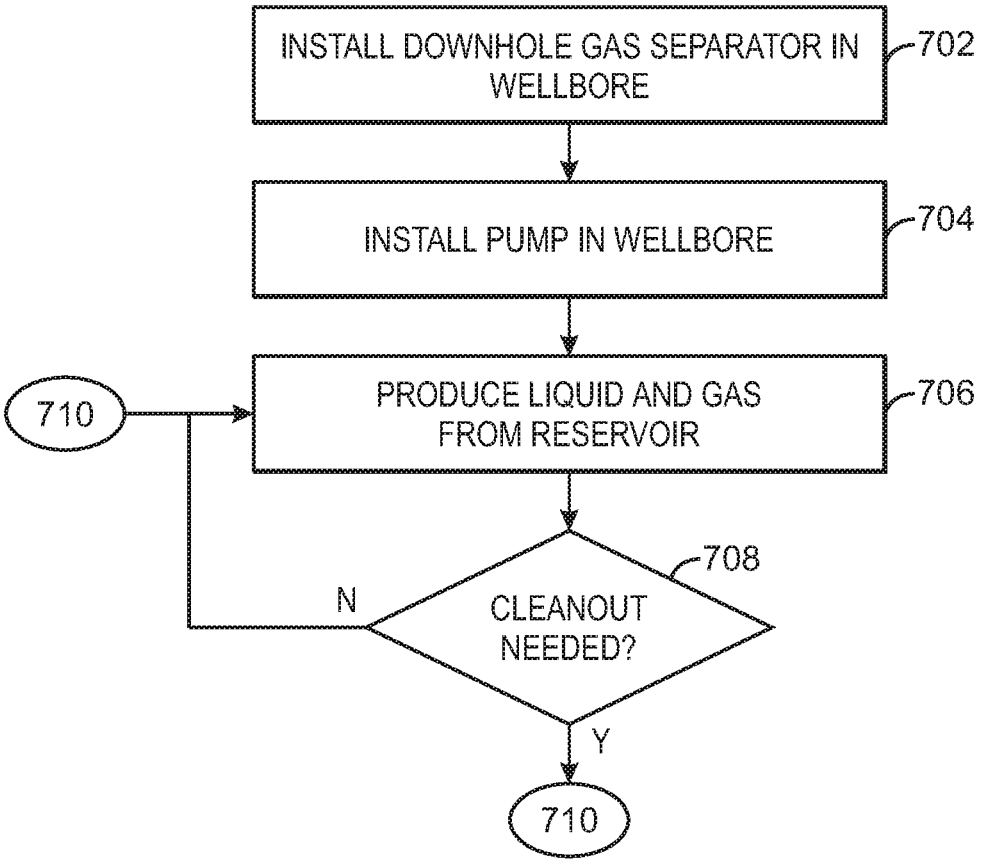
FIGS. 7(A) and 7(B) are process flow charts of a method for performing a well intervention using the downhole gas separator, in accordance with examples.
Figure 7B:
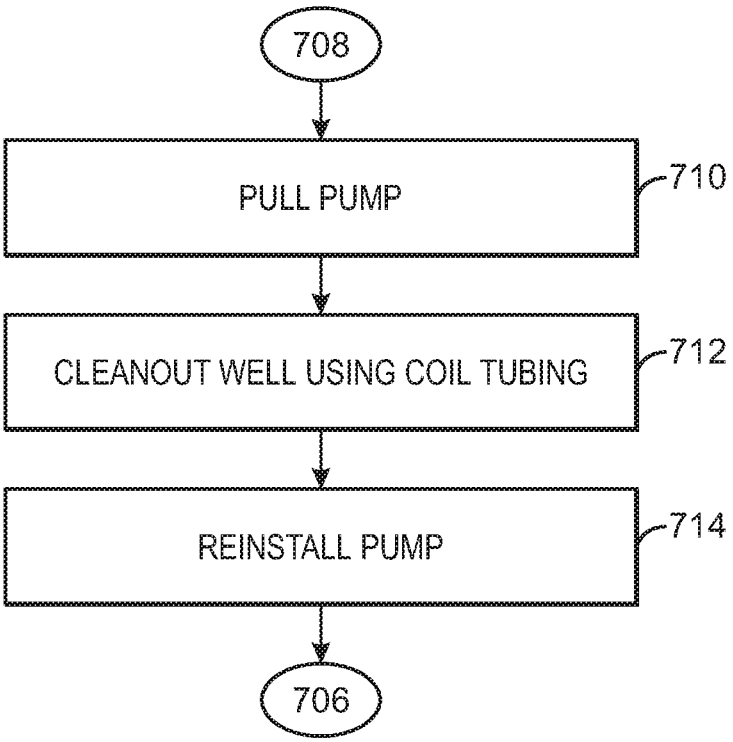

FIGS. 7(A) and 7(B) are process flow charts of a method 700 for performing a well intervention using the downhole gas separator, in accordance with examples. The method begins at block 702, when the downhole gas separator is installed in the wellbore. This is performed by attaching the downhole gas separator to the end of production tubing used to produce liquids from the reservoir, or to the pump, depending on the design selected. The downhole gas separator is then threaded into the wellbore to the operational location.

At block 704, a pump is installed in the wellbore, for example, being lowered through the production tubing. The pump may be a reciprocating piston pump or an ESP, among others. In an example, the pump is installed in the dip tube of the downhole gas separator. The pump is then coupled to the power source, for example, being coupled to a rod connected to a pump jack, or to a downhole power line.

At block 706, liquid and gas are produced from the reservoir. As described herein, the downhole gas separator preferentially pulls liquid from a pool of liquid in the wellbore, allowing the gas to be produced from the well casing.

At block 708, a determination is made as to whether a well intervention, such as a well cleanout operation, wireline insertion, or other well refurbishing operation, is needed. The determination may be made, for example, by monitoring a production rate, an increase in a water/oil ratio, or other indication that well servicing is needed. If no well intervention, is needed, then process flow returns to block 706, and production continues.

If it is determined at block 708 that well intervention is needed, process flow proceeds to block 710 (FIG. 7(B)). At block 710, the pump is pulled from the well. This may be performed by pulling the rod and the connected pump from the well together.

At block 712, the well intervention is performed using a well intervention tool, such as a coiled tubing line, wireline, or other well intervention tool. The well intervention procedure may involve sand removal, additional fracking procedures, chemical treatment procedures, replacement of broken equipment, and the like.

At block 714, the pump is reinstalled. This may follow the same procedure as described with respect to block 704. Once the pump is reinstalled, process flow resumes at block 706 (FIG. 7(A)) with the production of liquid and gas from the reservoir.

While the present techniques may be susceptible to various modifications and alternative forms, the example examples discussed above have been shown only by way of example. However, it should again be understood that the present techniques are not intended to be limited to the particular examples disclosed herein. Indeed, the present techniques include all alternatives, modifications, and equivalents within the spirit and scope of the appended claims.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A system to produce liquids from a well, comprising:
well casing and production tubing placed inside the well casing configured to transfer liquid to a surface with a pump; and
a downhole gas separator, comprising a separation section, wherein the separation section comprises a plurality of openings over an extended length;
wherein the system further comprises an extension section mounted to the separation section at an opposite end of the separation section from the pump, and wherein the extension section comprises an eccentric weight distribution to align the plurality of openings with a bottom surface of the well.

2. The system of claim 1, wherein a size of each of the plurality of openings, a number of the plurality of openings, or both, is increased as a distance from the production tubing is increased.

3. The system of claim 1, wherein the separation section is fluidically coupled to the production tubing at one end.

4. The system of claim 1, wherein the separation section comprises:
a rotating joint to allow the separation section to rotate; and
a weighted plate mounted to a bottom of the separation section configured to rotate the separation section under the force of gravity to align the base of the separation section with a bottom surface of a wellbore.

5. The system of claim 1, comprising a wellhead, wherein the wellhead fluidically couples the production tubing to a production line for the liquids, and fluidically couples the well casing to a gas line.

6. The system of claim 1, wherein the separation section is fluidically coupled to the pump.

7. The system of claim 1, wherein the pump comprises a reciprocating piston pump.

8. The system of claim 7, comprising a pump jack coupled to the reciprocating piston pump through a rod.

9. The system of claim 1, wherein the pump comprises a progressive cavity pump.

10. The system of claim 9, comprising a motor coupled to the progressive cavity pump through a rod.

* * * * *